US005735642A

United States Patent [19]

Barringer

[11] Patent Number: 5,735,642

[45] Date of Patent: Apr. 7, 1998

[54] TRENCH SHIELD HANDLING ASSEMBLY

[75] Inventor: Luther Bradford Barringer, Richfield, N.C.

[73] Assignee: Efficiency Production, Inc., Mason, Mich.

[21] Appl. No.: 618,310

[22] Filed: Mar. 19, 1996

[51] Int. Cl.[6] ..... F02D 17/10; B66C 1/00

[52] U.S. Cl. ..... 405/282; 405/272; 405/157; 294/67.1

[58] Field of Search ..... 405/272, 274–281, 405/282, 283, 287, 285, 232, 231, 246, 247, 303, 157; 269/46; 294/67.1, 67.3, 81.5

[56] References Cited

U.S. PATENT DOCUMENTS

| | | | |
|---|---|---|---|
| 158,434 | 1/1875 | Newcomb | 294/67.3 |
| 1,415,090 | 5/1922 | Fitch . | |
| 1,587,301 | 6/1926 | Itancey, Jr. | 294/67.1 |
| 1,919,549 | 7/1933 | Fryslie | 294/67.3 X |
| 3,606,438 | 9/1971 | Pezzko | 294/67.3 X |
| 4,358,145 | 11/1982 | Svensson | 294/81 |
| 4,557,630 | 12/1985 | Neil | 405/232 |
| 4,576,542 | 3/1986 | Brasell et al. | 294/67.1 X |
| 4,826,228 | 5/1989 | Dinitz et al. | 294/67.1 X |

FOREIGN PATENT DOCUMENTS

| | | | |
|---|---|---|---|
| 1383953 | 10/1963 | France | 405/283 |
| 2613341 | 10/1988 | France | 294/67.3 |
| 929789 | 5/1982 | U.S.S.R. | 405/283 |

OTHER PUBLICATIONS

"The Rugged Ones" Griswold Machine and Engineering, Inc., Jul. 1976.

*Primary Examiner*—Tamara L. Graysay
*Assistant Examiner*—Frederick L. Lagman
*Attorney, Agent, or Firm*—Miller, Morriss & Pappas

[57] ABSTRACT

A rotatable trench shield handling assembly provided with upwardly extending excavator hook-engaging means. The rotatable trench shield handling assembly provided with rear downwardly extending trench shield wall engaging means and with an opposed forward transversely positioned horizontally oriented trench shield wall engaging guide stabilizer bar means which cooperates with the rear spaced apart trench shield wall engaging means to positively and easily engage the trench shield so as to enable the excavator operator to have positive control of the trench shield while lifting, handling, lowering, and selectively stacking the trench shield into its operative use position within a trench and subsequently removing the trench shield therefrom.

3 Claims, 10 Drawing Sheets

TRENCH SHIELD HANDLING ASSEMBLY

This invention relates to a trench shield handling assembly which enables an excavator operator to have full control of the trench shield so as to safely and easily retainably engage, lift and handle or manipulate trench shields so as to selectively position and stack the trench shields into their operative use position within a trench and subsequently, to selectively remove the trench shields from the trench while having full positive control thereof at all times.

Further, this invention also relates to a trench shield handling assembly provided with a pair of spaced apart downwardly extending trench shield wall engaging means and with an opposed transversely positioned horizontally oriented trench shield wall engaging guide stabilizer bar means which cooperates with the spaced apart trench shield wall engaging means to positively and easily engage the trench shield so as to enable the excavator operator to have positive control while lifting, handling, lowering and selectively stacking the trench shield into its operative use position within a trench and subsequently removing the trench shield therefrom.

This invention also relates to a trench shield handling assembly having an upwardly extending excavator hook-engaging means adapted to enable an excavator operator to pick up the trench shield handling assembly by moving the excavator bucket so that the downwadly depending hook provided thereon into operative use engagement with the upwardly extending hook-engaging means provided on the trench shield handling assembly.

This invention further relates to a trench shield handling assembly which avoids the use of cables and/or chains to engage the trench shield and safely stack it in its operative use position within a trench, thus avoiding time-consuming cable and chain installation and avoiding accidents brought about by failure of such cables and chains and avoiding the dangerous swaying inherent in the use of cables.

It should be noted that this Trench Shield Handling Assembly provides positive, quick and safe control of the trench shield while the excavator operator is handling, lifting, manipulating and stacking the trench shield selectively into and of its operating use position in a trench. The prior art trench shield handling devices have utilized cables and/or chains which must laboriously be attached between the lifting hoist and the trench shield so as to place the trench shield in its operative use position within a trench. Not only is it time consuming and expensive to selectively attach and detach the cables and/or chains, the overall use of such cables and/or chains is inherently dangerous due to the possibility of failure of the cables per se, the connections between the cables and the trench shields. More significantly, the use of the cables do not provide the positive control which is inherent in the use of the instant invention which eliminates the swaying brought about by use of the cable support sytem.

The use of the instant invention also greatly facilitates the insertion and stacking of the trench shields with the trench.

All of the prior known art trench shield handling devices or systems utilize cables and/or chains to, in one way or another, engage or support the trench shield while it is lifted and lowered into its operative use within the trench. None of the prior known art devices teach a trench shield handling assembly such as the instant invention which provides positive control of the trench shield so as to facilitate the work of the excavator operator in safely handling, transfering, stacking and lowering the trench shield into its operative use position within a trench and selectively removing the trench shield therefrom.

A need has therefore existed for a trench shield handling assembly which provides positive and safe, controlled handling of the trench shield selectively into and out of its operative use position within a trench and avoids the use of cables in accomplishing that goal.

It is, therefore, an object of this invention to provide a trench shield handling assembly which provides positive and safe control of the trench shield while it is transferred to and from its operative use position within a trench and which greatly expedites such transfers.

Other objects and advantages found in the construction and use of this invention will be apparent from a consideration in connection with the appended claims and the accompanying drawings.

IN THE DRAWINGS

DESCRIPTION

Figure 1:
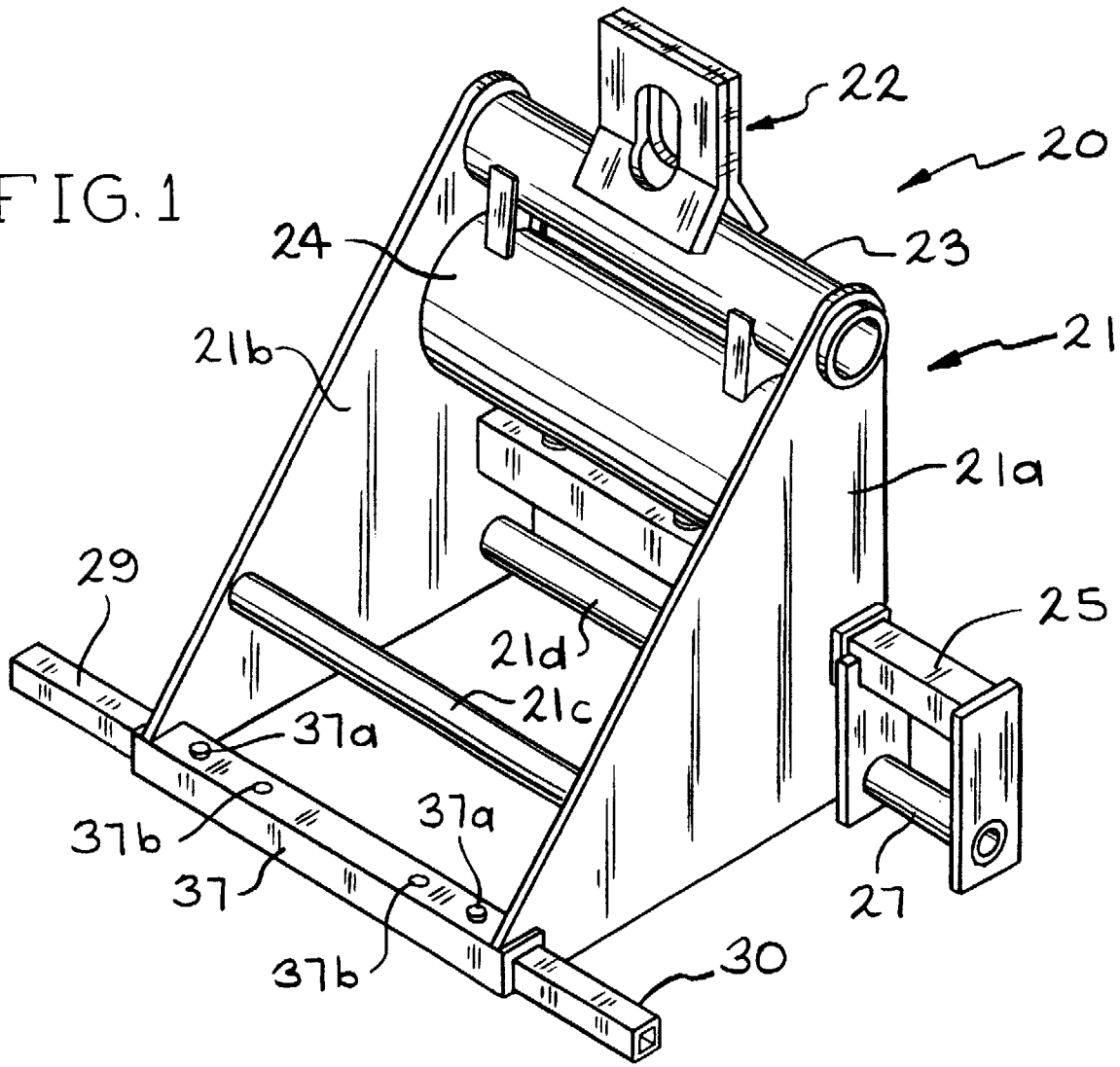
FIG. 1 is a front perspective view of an embodiment of the trench shield handling assembly.

As shown in FIG. 1, the trench shield handling assembly 20 comprises a frame 21.

The frame 21 is comprised of spaced-apart side walls 21*a* and 21*b* which are fixedly connected by cross support elements 21*c* and 21*d*, respectively. Other additional frame cross support elements will be hereinafter discussed.

The uppermost portion of the frame 21 supports an upwardly extending excavator hook-engaging means 22 which is fixedly supported on a rotatable support sleeve 23. A downwardly extending counterweight member 24 is also fixedly attached to the rotatable support sleeve 23 so as to always maintain the excavator hook-engaging means 22 in a vertical upwardly extending position when not in use. The basic operation of the excavator hook-engaging means 22 will be hereinafter shown and discussed with respect to FIGS. 3, 4, 5 and 6.

Figure 2:
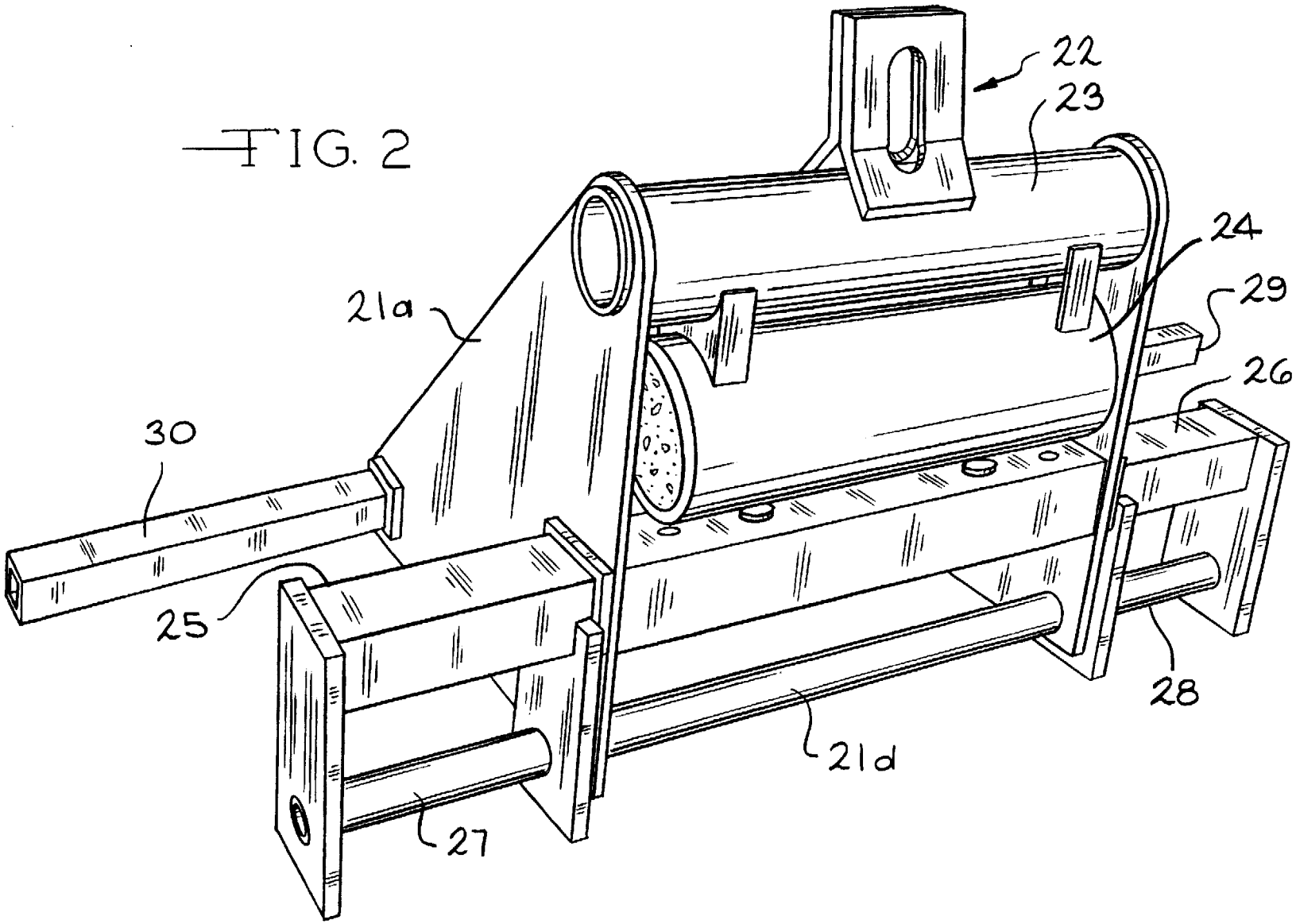
FIG. 2 is a rear perspective view thereof.
Figure 3:
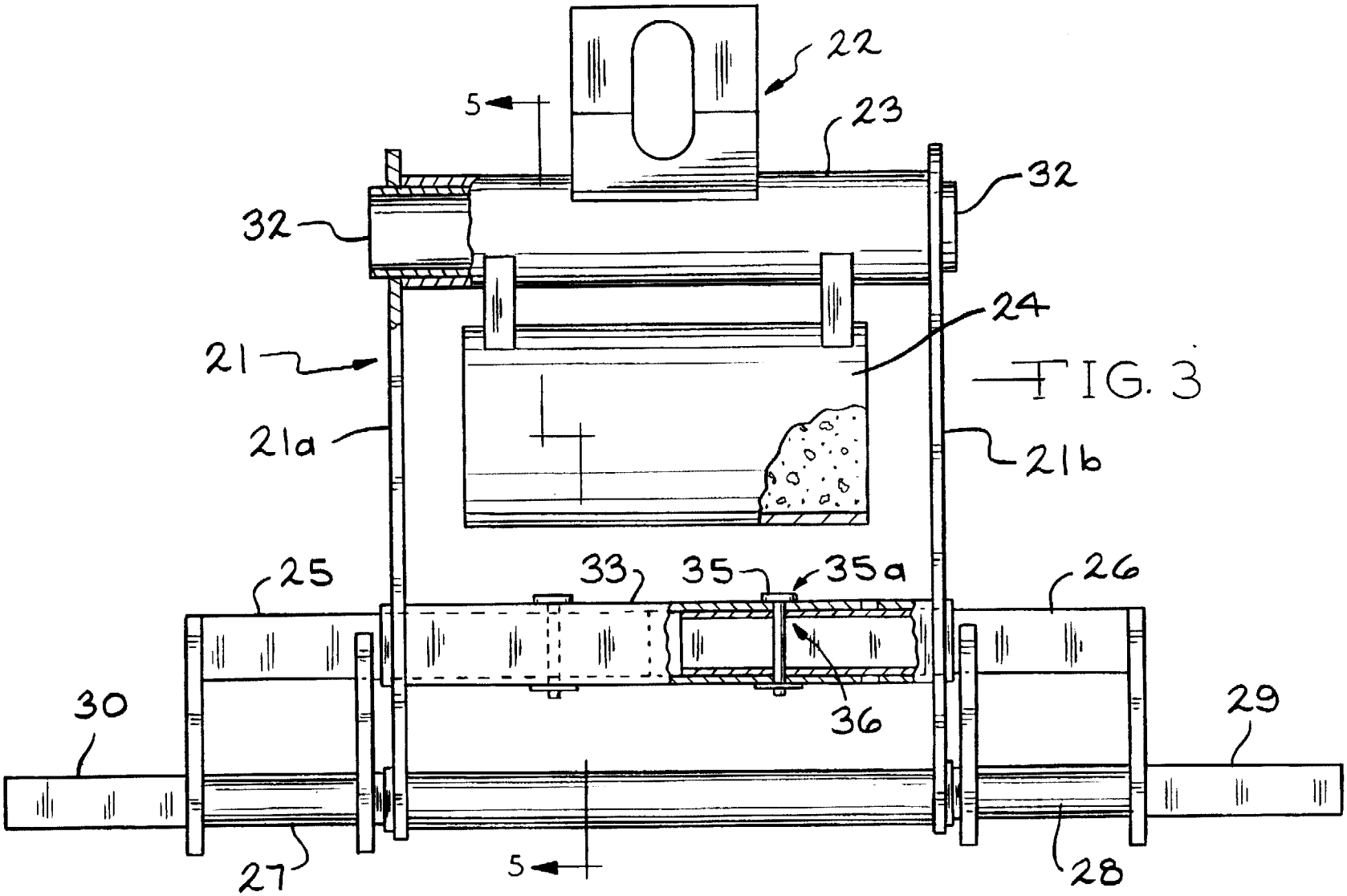
FIG. 3 is a rear elevation view thereof with portions broken away to show the mating relationship of several components therof.

As shown in FIG. 1, and in greater detail in FIGS. 2 and 3, the lower aft portion of the frame 21 supports outwardly extending adjustable lifting arms 25 and 26, respectively. The outer ends of the lifting arms 25 and 26 are provided with downwardly extending trench shield hook-engaging means 27 and 28, respectively. The operation of the lifting arms 25 and 26 will be hereinafter discussed with respect to FIGS. 6 and 6A.

Other embodiments of the trench shield handling assembly 20 utilize other types of trench shield engaging means which are deemed to be in the scope of this invention and will be hereinafter shown and discussed.

Figure 6:
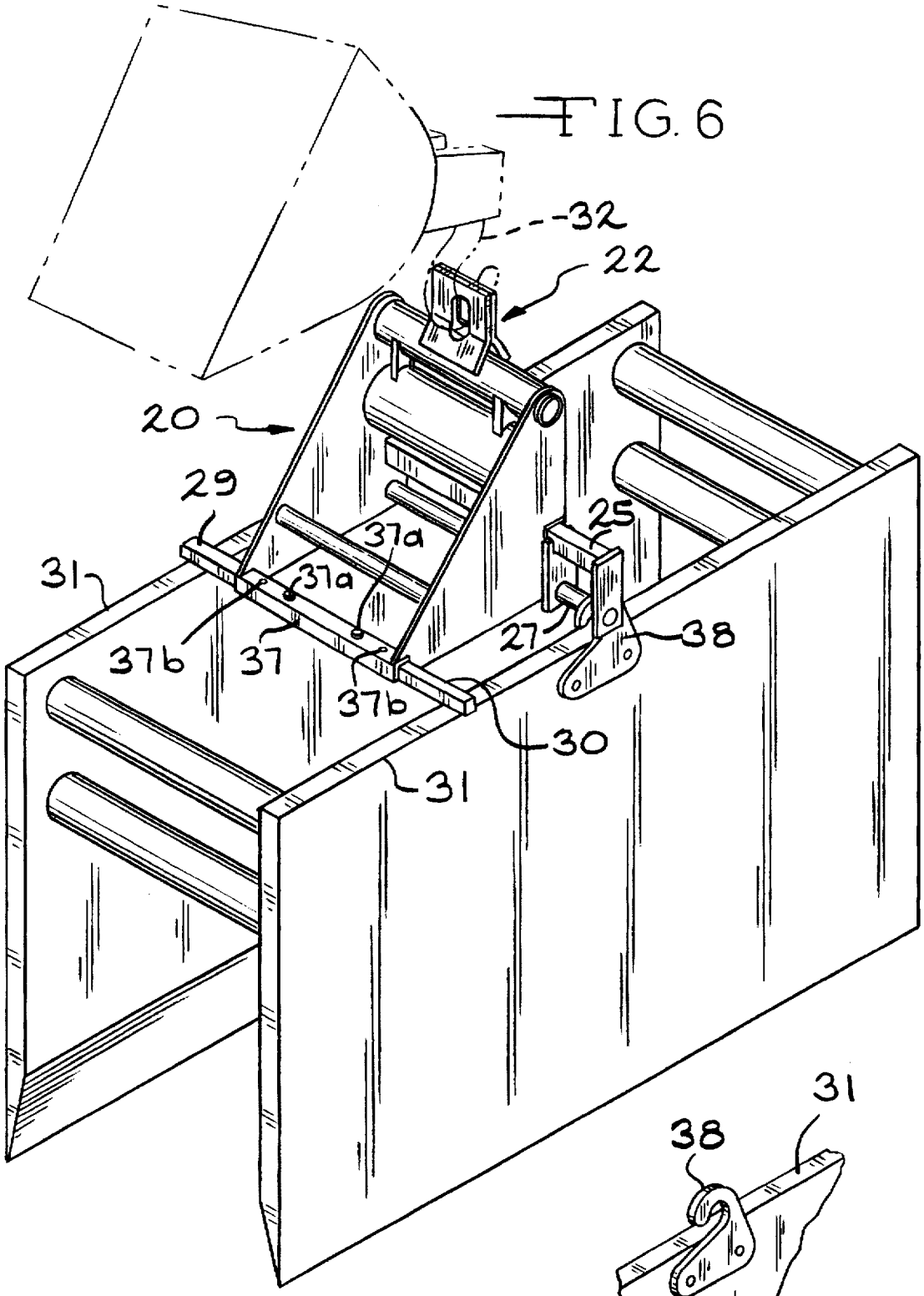
FIG. 6 is a front perspective view of the trench shield handling assembly in its operative use engagement with a trench shield and showing in phatom-line the hock of an excavator bucket in lifting engagement therewith.
Figure 6A:
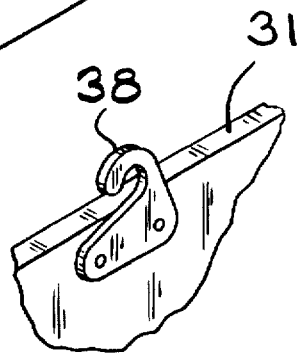
FIG. 6A is a partial schematic view of an embodiment of one of the pair of spaced-apart trench shield handling assembly hooks provided on the trench shield walls.

As further shown in FIGS. 1, 2 and 6, the lower fore portion of the frame 21 supports stabilizer guide arms 29 and 30, respectively, which extend outwardly from the frame 21. As shown in FIG. 6, the stabilizer guide arms 29 and 30, respectively engage the upper edges of the trench shield walls 31 when in operational use.

While the stabilizer guide arms 29 and 30 and the lifting arms 25 and 26 are shown as being adjustable so as to accommodate various widths of trench shields 31, it is considered to be in the scope of the invention that the lifting arms and stabilizer guides can be combined into fixed non-adjustable lengths for specific use with a single size of trench shield.

Figures 4, 5:
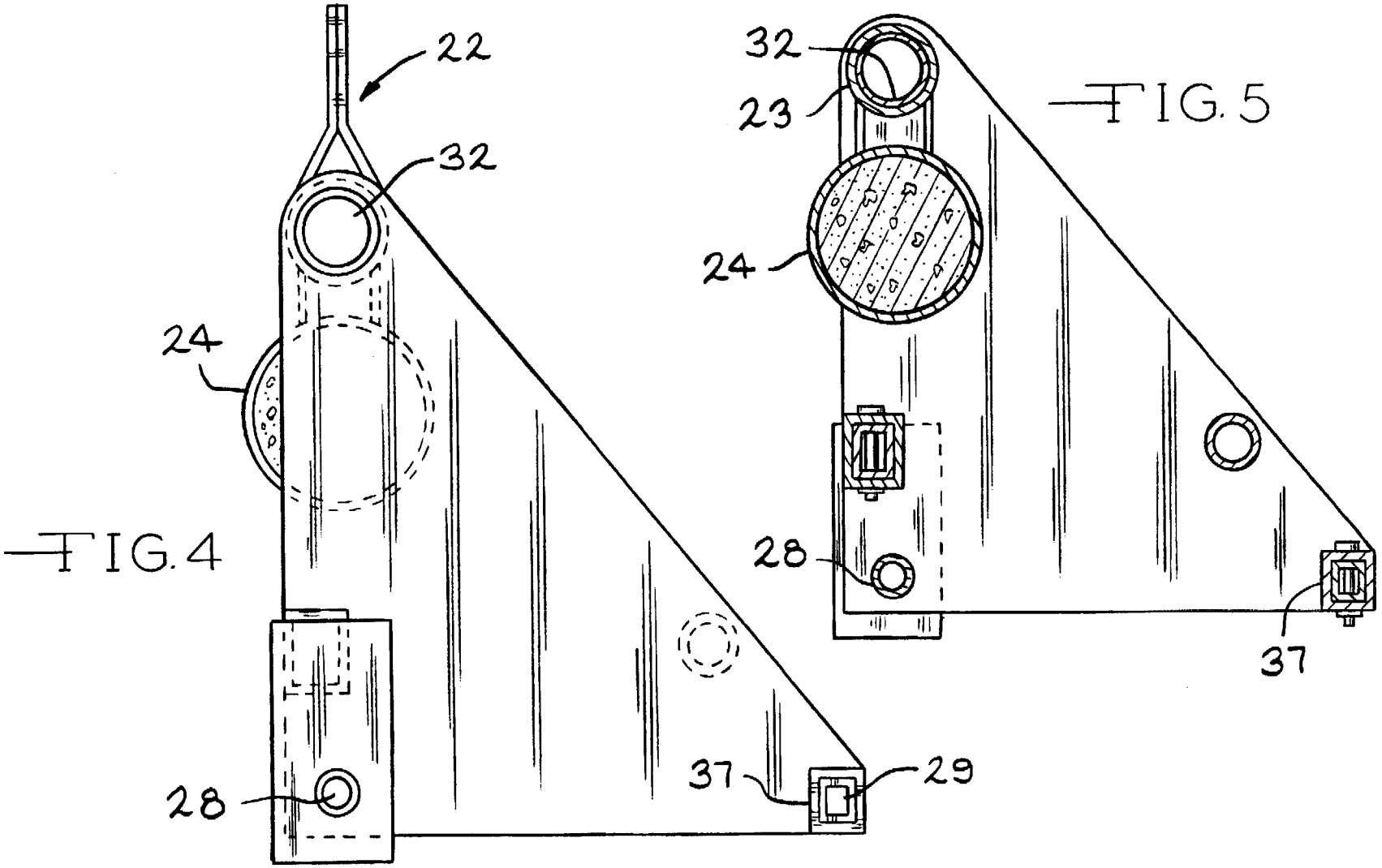
FIG. 4 is a right side elevation view thereof.
FIG. 5 is a cross-sectional view thereof taken on line 5—5 of FIG. 3.

The basic overall operation of the various components of the trench shield handling assembly 20 is shown in the schematic breakaway view of FIG. 3, and schematic end view of FIG. 4 and the cross-sectional view of FIG. 5.

As shown in the breakaway section in the upper portion of the frame 21, a cross-support member 32 is fixedly provided on the frame 21 extending between the frame walls 21*a* and 21*b*. A sleeve member 23 is rotatably mounted on the cross-support member 32. As previously discussed, the upwardly extending excavator book-engaging means 22 are fixedly attached to the sleeve member 23. The downwardly extending counterweight member 24 is also fixedly attached to the sleeve member. Although the counterweight 24 is shown as a weighted cylinder, it is within the scope of the invention to utilize any shape and material as a counterweight, as long as it maintains the excavator hook-engaging means 22 in its normal vertically upright rest position.

As further shown in the lower aft breakaway portion of FIG. 3, a cross support member 33 is provided on the frame 21 so as to extend between the walls 21*a* and 21*b*. The cross support member 33 is provided with adjustment pin receiving holes 35*a* therethrough so as to receive adjustment pins 35 therethrough and to pass through corresponding pin receiving holes 36, thus selectively retaining the lifting arms 25 and 26 in any desired expanded position in relation to the width of the trench shield 31 being handled.

As shown in the lower forward portion of FIGS. 1, 3, and 6, a cross support member 37 is provided on the frame 21 for adjustably receiving stabilizer guide arms 29 and 30 therein. The stabilizer guide arms 29 and 30 can be selectively extended outwardly from the trench shield handling assembly 20 so as to extend over the trench shield walls 21*a* and 21*b*, respectively, so as to operably engage the top surfaces of any width size trench shield 31. As shown in FIGS. 1 and 6, the stabilizer guide arms 29 and 30 can be selectively secured in any desired extended position by use of adjustment pins 37*a* placed through adjustment pin receiving holes 37*b* provided through the cross support member 37 and the stabilizer guide arms 29 and 30.

The schematic end view of FIG. 4 shows in phantom line the various components of the trench shield handling assembly as previously described.

The cross-sectional view of FIG. 5 taken on line 5—5 of FIG. 3 shows in additional detail the interrelationship between the various cross support members and the mating sleeve 23, the lifting arms 25 and 26 and the stabilizer guide arms, respectively.

As shown in the perspective view of FIG. 6, the trench shield handling assembly 20 has been lifted into its operating use position in full positive engagement with the trench shield 31.

In use, the excavator operator has engaged the trench shield handling assembly 20 by moving the excavator bucket hook 32 (shown in phantom line) into operative engagement with the upwardly extending excavator hook-engaging means 22. The excavator operator then lifts the trench shield handling assembly 20 into its engagement position over the trench shield 31. By virtue of the positive control imparted to him by the trench shield handling asembly, the excavator operator gently lowers the trench shield handling assembly 20 until the stabilizer guides 29 and 30 contact the upper surfaces of the trench shield 31 forward of the hook means 38 provided on each wall of the trench shield 31. As shown in partial schematic view of FIG. 6A, the hook means 38 are positioned on the outside of each trench shield wall and extend upwardly therefrom as shown.

Figure 7:
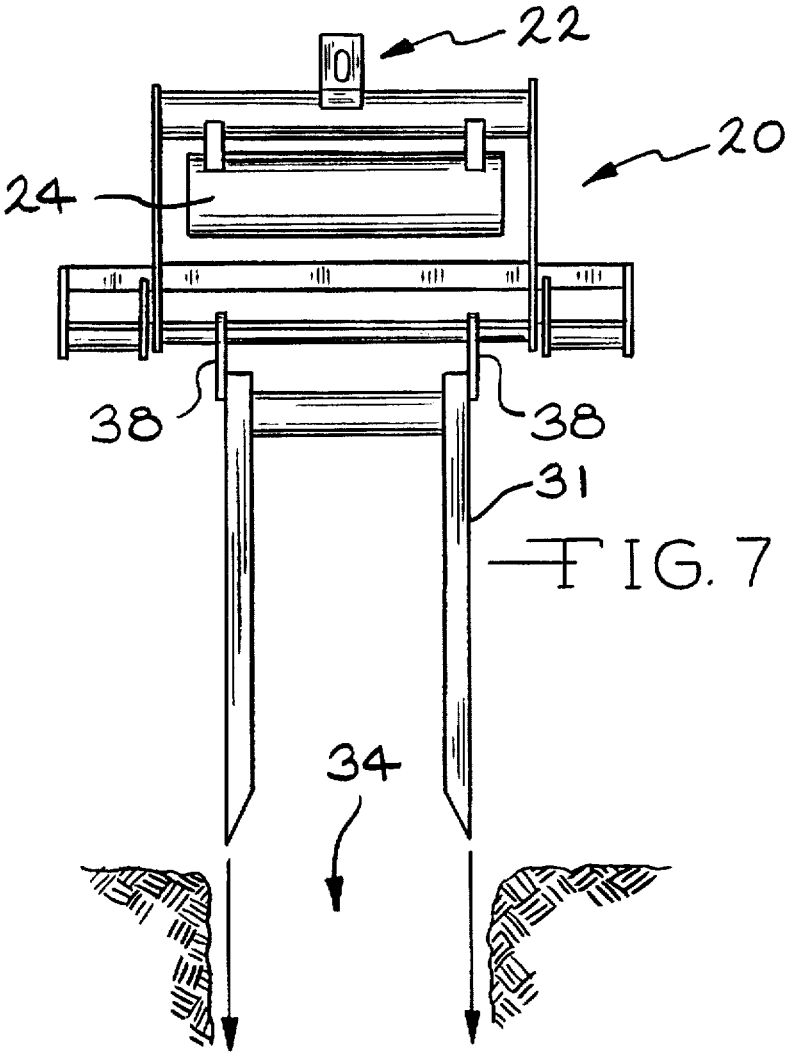
FIG. 7 is a schematic view of the trench shield suspended from the trench shield handling assembly and showing it about to be lowered into its operative use position within a trench.

The excavator operator then pulls the trench shield handling assembly rearwardly toward the hook means 38 provided on each of the trench shield walls until the hook means are in lifting engagement with the downwardly extending hook-engaging means 27 and 28 provided on the lifting arms 25 and 26. As the excavator operator lifts the trench shield 31, the trench shield rotates counter-clockwise slightly into full engagement with the stabilizer guide arms 29 and 30, thus imparting full control by coaction of the stabilizer arms and lifting engagement with the downwardly extending hook-engaging means 27 and 28. As shown in FIG. 7, the excavator operator then moves the trench shield 31 over an open trench 34. The excavator operator then lowers the trench shield 31 into its operative use position within the trench 34 and the excavator operator then easily disengages the trench shield handling assembly from the trench shield by reversing the foregoing engagement procedure. When the work within the trench is completed, the excavator operator can easily re-engage the trench shield and remove it from the trench without the need for extra workers to engage cables as has been required in the prior art devices.

Figure 8:
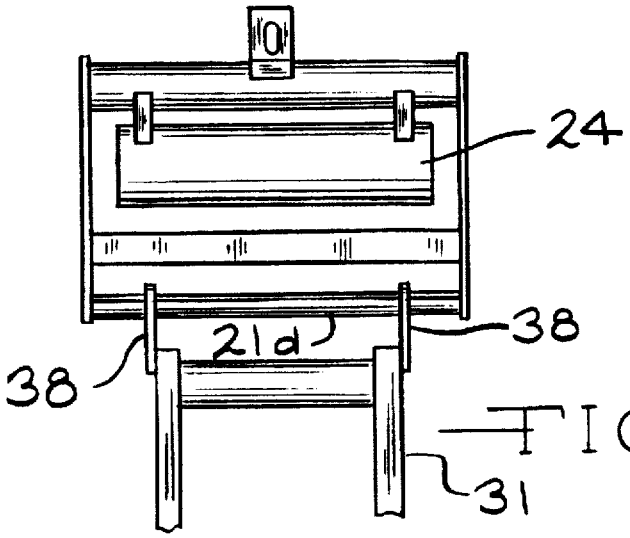
FIG. 8 is another embodiment of the trench shield handling assembly modified for sole use with narrow width trench shields.

As shown in the schematic drawing of FIG. 8, the trench shield handling assembly 20 can be modified for specific use with narrow width trench shields by eliminating the lifting arms 25 and 26 and downwardly extending trench shield hook engaging means 27 and 28. In this embodiment, the trench shield hooks 38 directly engage the trench shield handling assembly cross member 21*d*.

Figure 9:
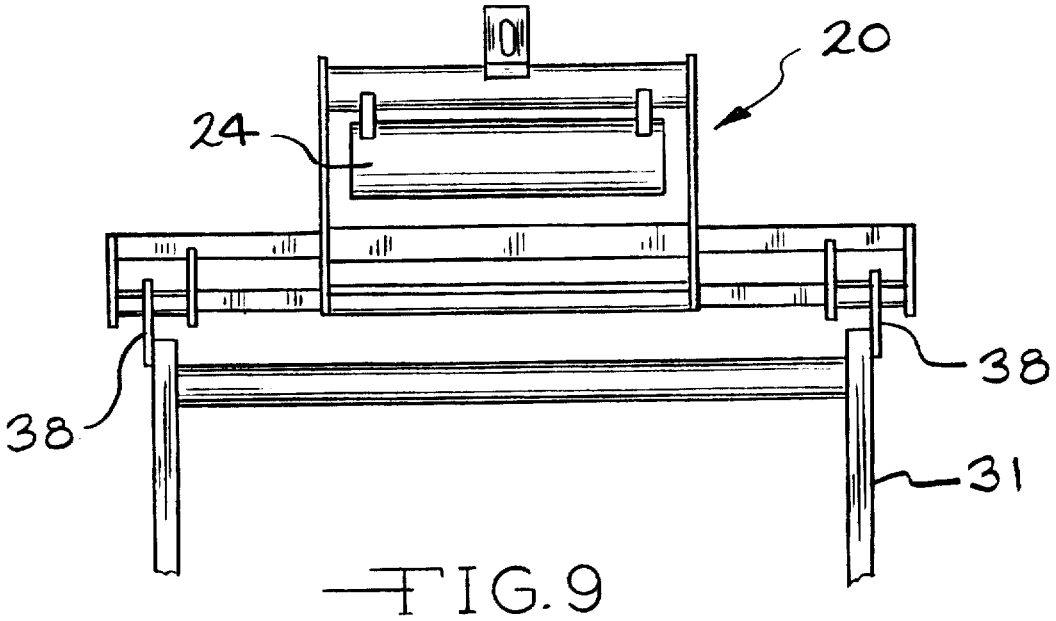
FIG. 9 is a schematic view showing the trench shield handling assembly adjusted for use with large width trench shields.

In the schematic view of FIG. 9, the trench shield handling assembly is shown with the lifting arms 25 and 26 extended to adapt the trench shield handling assembly for working with wider trench shield units.

Figure 10:
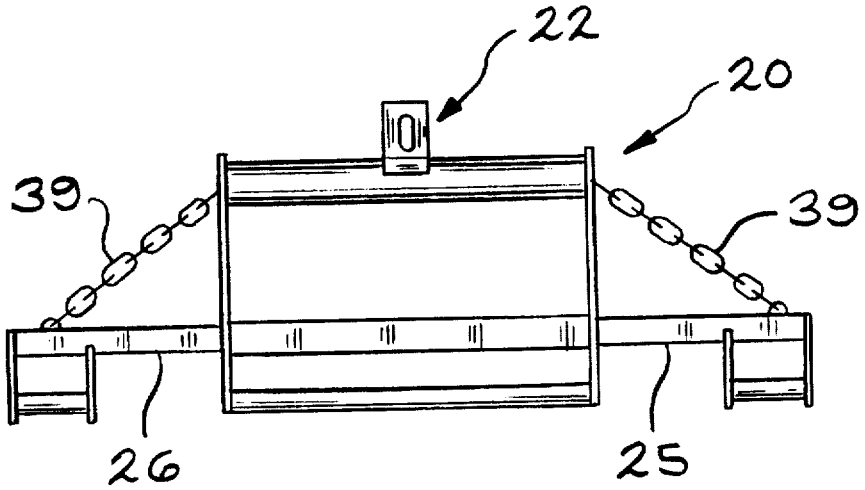
FIG. 10 is a schematic view of the trench shield handling assembly modified to provide extra strengthening support for use with heavier trench shields.

In the schematic view of FIG. 10, the trench shield handling assembly is provided with support chains 39 extending to the lifting arms to provide extra support when lifting heavier trench shields.

Figure 11:
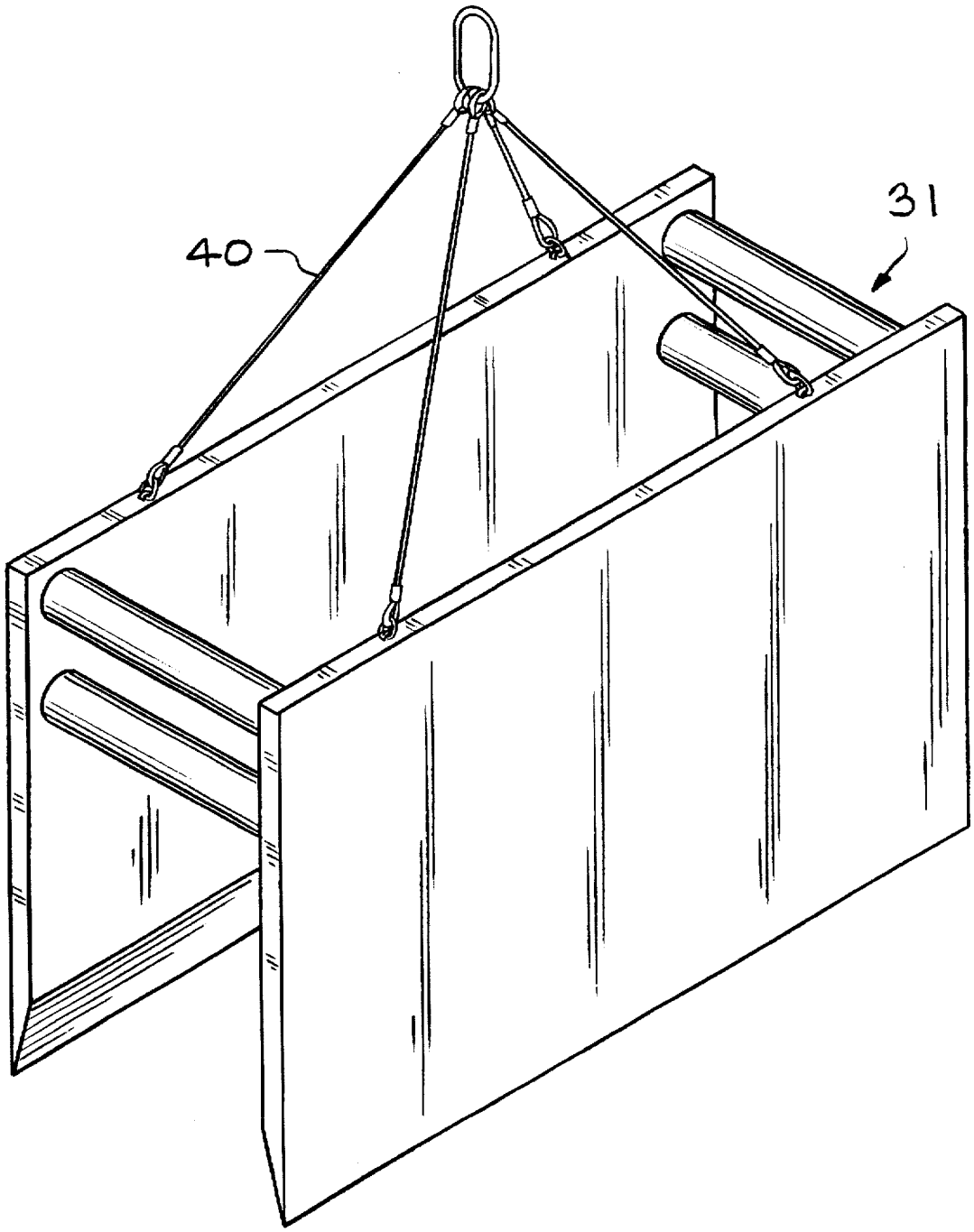
FIG. 11 PRIOR ART
FIG. 11 is a perspective view showing the prior art method of lifting the trench shield by four cables.

In the schematic view of FIG. 11, the prior art method of utilizing cables 40 to lift and handle the trench shields, is shown. The use of cables requires time-consuming and expensive labor to attach the cables. Further, the use of cables is not only dangerous because they can snap, but their tendency to sway inherently does not impart positive control in the handling of heavy trench shields.

Figure 12:
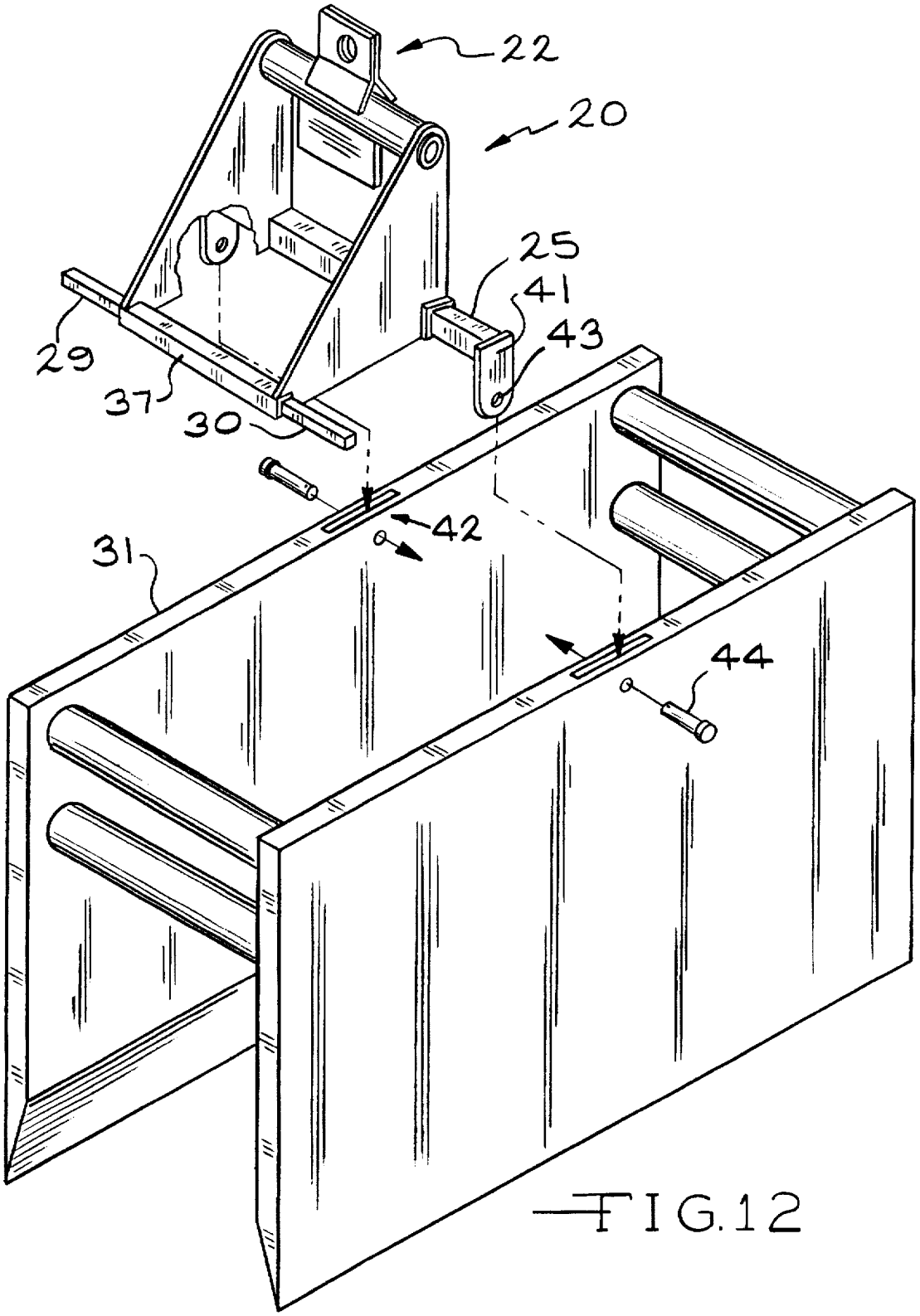
FIG. 12 is another embodiment of the trench shieled handling assembly showing a different method of retainably engaging the trench shield.
Figure 13:
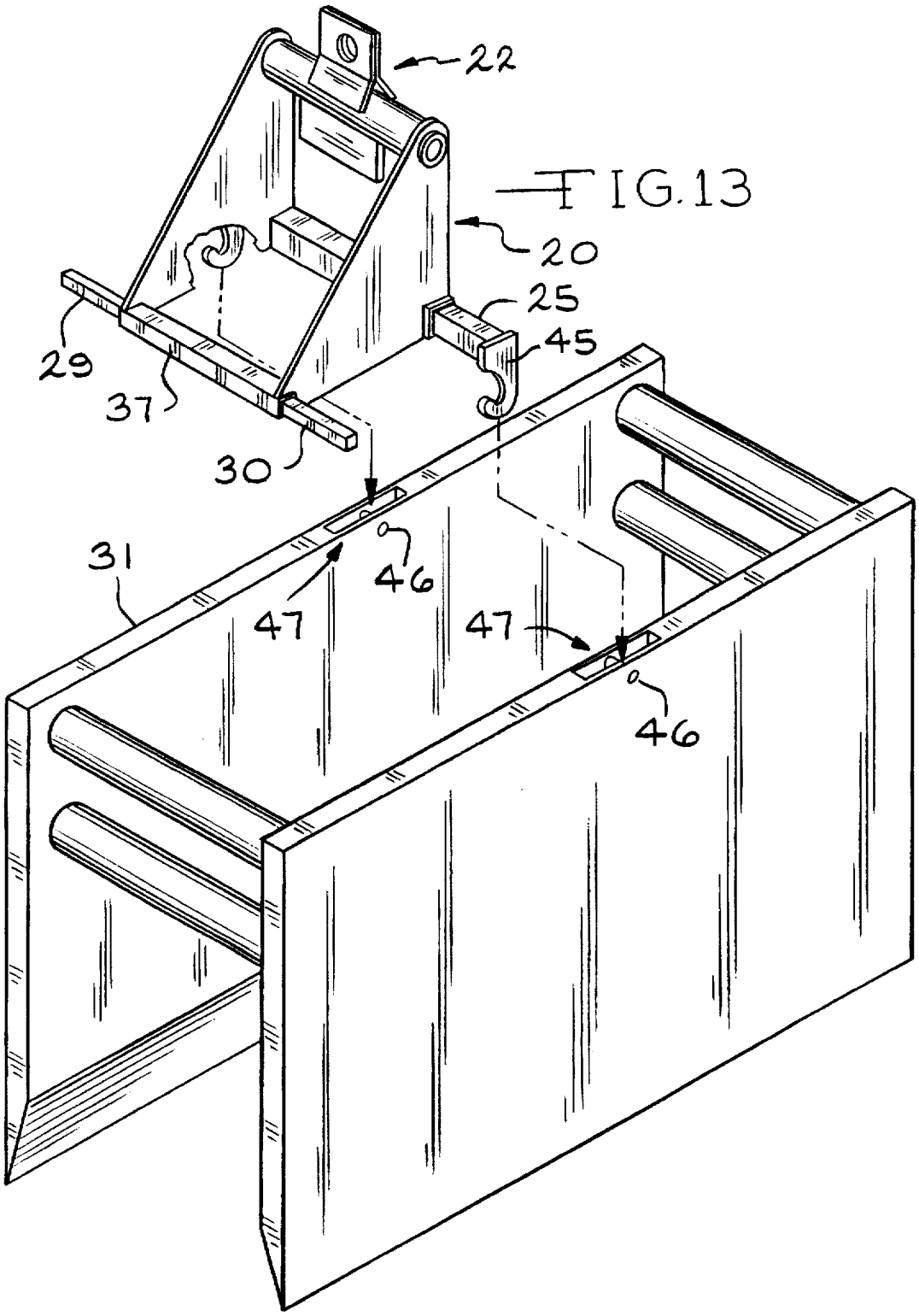
FIG. 13 is another embodiment of a trench shield handling assembly showing yet another method of retainably engaging the trench shield.

The schematic view of FIG. 12 shows another embodiment of the trench shield handling device which has been modified to provide lifting arms 25 and 26 having downwardly extending shield engaging means 41 which engage slots 42 provided in the upper surfaces of the shield walls. The shield engaging means 41 are provided with a hole 43 therethrough which is secured by a retaining pin 44 passing therethrough. As shown in FIG. 13, another embodiment of the trench shield handling assembly is modified to have downwardly extending trench shield engaging hook means 45 which are adapted to engage a hook retaining cross bar 46 positioned within slots 47 provided within the upper surfaces of the trench shield walls.

It is within the scope of the invention to include other variations of shield wall engaging lifting means as long as the stabilizer guide means coact with such shield wall engaging lifting means to provide positive control in the handling of trench shields as embodied in the trench shield handling assembly shown and claimed herein.

The trench shield handing assembly is provided to safely and easily retainably engage a trench shield so as to have positive control thereof during lifting, handling, stacking thereof within its operative use position within a trench. The trench shield handling assembly comprises a frame which is provided with upwardly extending excavator hook-engaging means. A pair of lifting arms are selectively extendable outwardly from said frame. The lifting arms are provided with downwardly extending trench shield wall engaging means. Horizontally oriented stabilizer guide trench shield wall engaging means are provided on the frame in spaced apart opposed position from the pair of lifting arms and trench shield wall engaging means. The stabilizer guide means coacts with the trench shield wall engaging means to provide positive control of a trench shield in engagement therewith. A method is provided for selectively engaging a trench shield so as to have positive control thereof while placing it in its operative use position. The following steps comprise the method:

(1) selectively engaging a downwardly extending excavator hook with a trench shield handling assembly;

(2) retainably engaging a trench shield with downwardly extending trench shield retaining members provided on said trench shield assembly;

(3) operatively engaging the trench shield walls with a stabilizer guide member provided on said trench shield assembly so that the stabilizer guide member coacts with the trench shield retaining member to impart positive handling control over the trench shield.

Various other modifications of the invention may be made without departing from the principle thereof. Each of the modifications is to be considered as included in the hereinafter appended claims, unless these claims by their language expressly provide otherwise.

I claim:

1. In a trench shield handling assembly selectively adapted to safely and easily retainably engage a trench shield so as to have positive control thereof during lifting, handling, stacking thereof within its operative use position within a trench comprising:

a frame, said frame provided with upwardly extending excavator hook-engaging means rotatably mounted on said frame, said excavator hook-engaging means provided with counterweight means so as to maintain said upwardly extending excavator hook-engaging means in a vertical upright position when not in use;

a pair of lifting arms selectively extendable outwardly from said frame, said lifting arms provided with downwardly extending trench shield wall engaging means;

horizontally oriented stabilizer guide trench shield wall engaging means provided on said frame in spaced apart opposed position from said pair of lifting arms and said trench shield wall engaging means, said stabilizer guide means coacting with saie trench shield wall engaging means to provide positive control of a trench shield in engagement therewith.

2. In the trench shield handling assembly of claim 1, wherein said horizontally oriented stablizer guide means are selectively extendable outwardly to engage wide trench shield walls.

3. A method for utilizing a rotatable trench shield handling assembly to selectively engage a trench shield so as to have positive control thereof while placing it in its operative use position, the method comprising:

(1) selectively engaging a downwardly extending excavator hook with a trench shield handling assembly;

(2) retainably engaging a trench shield with opposed spaced apart, downwardly extending trench shield retaining members provided on said trench shield handling assembly;

(3) operatively engaging the trench shield walls with a stabilizer guide member provided on said trench shield handling assembly so that the stabilizer guide member coacts with the opposed spaced apart, downwardly extending trench shield retaining members provided on the trench shield handling assembly to impart positive handling control over the trench shield.

* * * * *